US011999541B2

(12) United States Patent
Reimann

(10) Patent No.: US 11,999,541 B2
(45) Date of Patent: Jun. 4, 2024

(54) HEXAGONAL SAFETY CONTAINER

(71) Applicant: Scott Allen Reimann, Greenwood Village, CO (US)

(72) Inventor: Scott Allen Reimann, Greenwood Village, CO (US)

( * ) Notice: Subject to any disclaimer, the term of this patent is extended or adjusted under 35 U.S.C. 154(b) by 0 days.

(21) Appl. No.: 16/694,553

(22) Filed: Nov. 25, 2019

(65) Prior Publication Data

US 2022/0332479 A1 Oct. 20, 2022

Related U.S. Application Data

(60) Provisional application No. 62/889,227, filed on Aug. 20, 2019.

(51) Int. Cl.

| | |
|---|---|
| ***B65D 50/04*** | (2006.01) |
| ***B65D 6/00*** | (2006.01) |
| ***B65D 43/20*** | (2006.01) |
| ***B65D 43/22*** | (2006.01) |
| *B65D 43/18* | (2006.01) |

(52) U.S. Cl.

CPC ..... *B65D 50/04* (2013.01); *B65D 11/10* (2013.01); *B65D 43/20* (2013.01); *B65D 43/22* (2013.01); *B65D 43/18* (2013.01); *B65D 2215/02* (2013.01)

(58) Field of Classification Search

CPC ..... B65D 50/046; B65D 43/18; B65D 43/20
See application file for complete search history.

(56) References Cited

U.S. PATENT DOCUMENTS

| | | | | |
|---|---|---|---|---|
| 297,378 | A * | 4/1884 | Gifford | B65D 43/18 220/823 |
| 6,679,381 | B1 * | 1/2004 | Bush | B65D 43/164 220/4.23 |
| 9,738,426 | B1 * | 8/2017 | Giraud | B65D 50/02 |
| 2003/0102321 | A1 * | 6/2003 | Maietta | B65D 83/0463 220/283 |
| 2004/0074917 | A1 * | 4/2004 | McHutchinson | B65D 83/0463 221/302 |
| 2004/0089668 | A1 * | 5/2004 | Lambelet, Jr. | B65D 43/164 220/283 |
| 2008/0149506 | A1 * | 6/2008 | Kuo | B65D 43/18 220/834 |

(Continued)

*Primary Examiner* — Ernesto A Grano
*Assistant Examiner* — Symren K Sanghera
(74) *Attorney, Agent, or Firm* — Husch Blackwell LLP

(57) ABSTRACT

The hexagonal packaging unit includes a container adapted to hold contents, wherein the contents are on or more of pharmaceutical composition or medical devices. The hexagonal packaging unit includes a lid pivotally connected and configured to slideably rotate on a pivot and engage a top of the container, wherein the lid is rotatable in a first direction between a closed position resulting in the lid covering an opening in the container, and an open position resulting in the opening of the container at least being partially open. The hexagonal packaging unit includes a first latch portion associated with the lid comprising a first release lever and a second release lever. The hexagonal packaging unit includes a second latch portion associated with the container positionable to engage the first latch portion when the lid is in the closed position, and disengage when the lid is in the open position.

10 Claims, 7 Drawing Sheets

(56) References Cited

U.S. PATENT DOCUMENTS

| | | | | |
|---|---|---|---|---|
| 2008/0190952 | A1* | 8/2008 | Strub | B65D 83/0472 221/25 |
| 2011/0079526 | A1* | 4/2011 | Blakeman | B65D 43/20 206/457 |
| 2011/0226772 | A1* | 9/2011 | Adler | B65B 69/00 220/315 |
| 2014/0367385 | A1* | 12/2014 | Spiegelhoff | B65D 51/242 220/345.4 |
| 2016/0052698 | A1* | 2/2016 | Lewis | B65D 83/08 29/428 |
| 2016/0052702 | A1* | 2/2016 | Lawrie | B65D 85/07 53/430 |
| 2016/0272382 | A1* | 9/2016 | Wagner | A61J 1/00 |
| 2017/0172846 | A1* | 6/2017 | Wagner | A61J 1/035 |
| 2018/0134467 | A1* | 5/2018 | Dagnelie | B65B 7/2842 |
| 2019/0062009 | A1* | 2/2019 | Georgiadis | B65D 43/0249 |
| 2019/0344937 | A1* | 11/2019 | Elkind | B65D 43/162 |
| 2022/0041344 | A1* | 2/2022 | Bailey | B65D 50/04 |

* cited by examiner

HEXAGONAL SAFETY CONTAINER

RELATED APPLICATIONS

This application claims priority to U.S. Application Ser. No. 62/889,227 filed on Aug. 20, 2019, the contents of which are herein incorporated by reference in its entirety.

FIELD OF THE INVENTION

The present invention relates generally to a child resistant medical package for enclosing pharmaceutical composition or for enclosing medical devices.

BACKGROUND

Medicate or pharmaceutical products, such as pills, capsules, tablets and/or liquid medicine, are typically packaged in child resistant medicate containers having a generally cylindrical base or housing with an open first end and an opposite closed second end. A cap or cover is rotatably mounted to the open end of the base and typically requires the user to perform a distinct finger and/or hand motion to remove the cap from the base. Unfortunately, conventional containers have several drawbacks.

There has been a long felt need for child resistant packaging units that are used to store a dispensable product in a protected manner such that the product can be dispensed by an intended user, yet be safeguarded against dispensing of the product by a child. The dispensable product (e.g., a medicine, supplement, herbal remedy, etc.) in tablet, caplet, capsule or powder form could be hazardous if ingested in uncontrolled quantities. The child resistant packaging unit incorporates features that discourage or prevent children from opening the unit. The child resistant packaging unit often takes the form of a container device moveably coupled to a closure member. The closure member may be moved and/or removed from the container device in order to dispense the dispensable product.

It has been long discussed by law-makers the issues surrounding protecting medications, pills, tablets, and capsules, while also ensuring that children are not able to easily access these medications. As such, law-makers have passed regulations concerning child resistant packaging. The use of child resistant packaging is well known throughout the art, and has been utilized for goods ranging from household items to pharmaceutical products.

Accordingly, there remains in the art a need for a packaging system that is economical to manufacture and assemble, lightweight, and provides child resistant security features. There also remains a need for a packaging system that permits withdrawal of the item stored therein without the use of a tool, and with little manipulation of a user.

Hence, an improved medical package would be advantageous, and in particular a medical package with improved child safe features would be advantageous.

SUMMARY OF THE INVENTION

Accordingly, it is an objective of the present invention to provide a child resistant and safety equipped packaging unit that is operable to hold pharmaceutical devices and medications.

The present invention relates to a child safety container for dangerous goods storage. In particular, the present invention is open to provide a child protection container having a cover which requires two independent operations, which is well suited for long-term clinical treatment housing containing a number of drugs.

Thus, the above described object and several other objects are intended to be obtained in a first aspect of the invention by providing a packaging unit comprising a container adapted to hold contents, wherein the contents are on or more of pharmaceutical composition or medical devices. Additionally, the packaging unit can comprise a lid pivotally connected and configured to slideably rotate on a pivot and engage a top of the container, wherein the lid is rotatable in a first direction between a closed position resulting in the lid covering an opening in the container, and an open position resulting in the opening of the container at least being partially open. The packaging unit can further comprise of a first latch portion associated with the lid comprising a first release lever and a second release lever. The packaging unit can further comprise of a second latch portion associated with the container positionable to engage the first latch portion when the lid is in the closed position, and disengage when the lid is in the open position.

In one embodiment, as a result of the first release lever and the second release lever being depressed, the first latch portion engages the second latch portion and the lid locks relative to the container, latching the first latch portion with the second latch portion.

In one embodiment, as a result of the first release lever and the second release lever being depressed, the first latch portion engages the second latch portion and the lid locks relative to the container, latching the first latch portion with the second latch portion.

In one embodiment, the lid and container each comprise of trapezoidal base panels located at two opposing parallel sides thereof.

In one embodiment, the container and the lid are child resistant.

In one embodiment, the container comprises of side walls extended from a base panel to the opening of the container.

BRIEF DESCRIPTION OF THE FIGURES

The packaging unit according to the invention will now be described in more detail with regard to the accompanying figures. The figures show one way of implementing the present invention and is not to be construed as being limiting to other possible embodiments falling within the scope of the attached claim set.

DETAILED DESCRIPTION OF EMBODIMENTS

Figure 1:
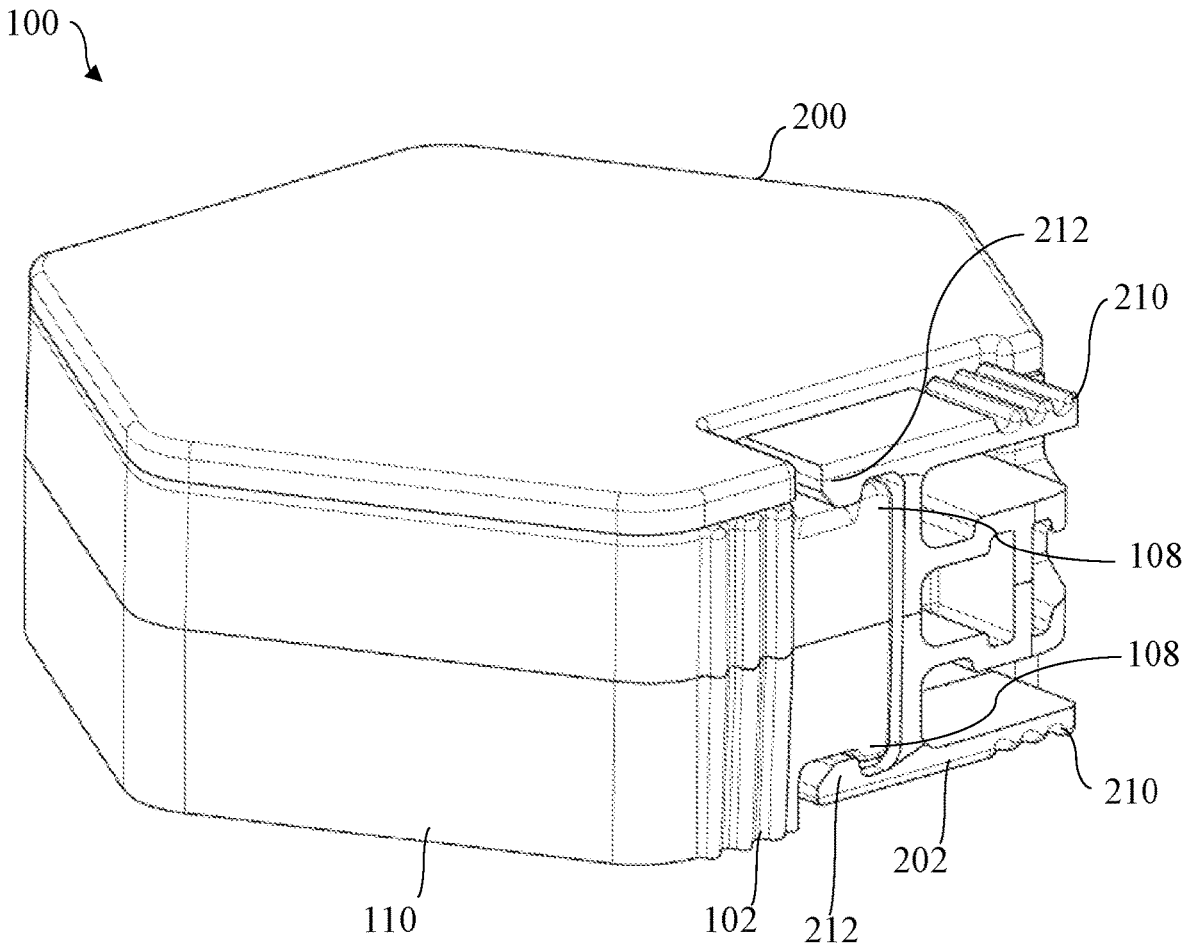
FIG. 1 depicts a top and side perspective view of a hexagonal container, in accordance with an example.
Figure 2:
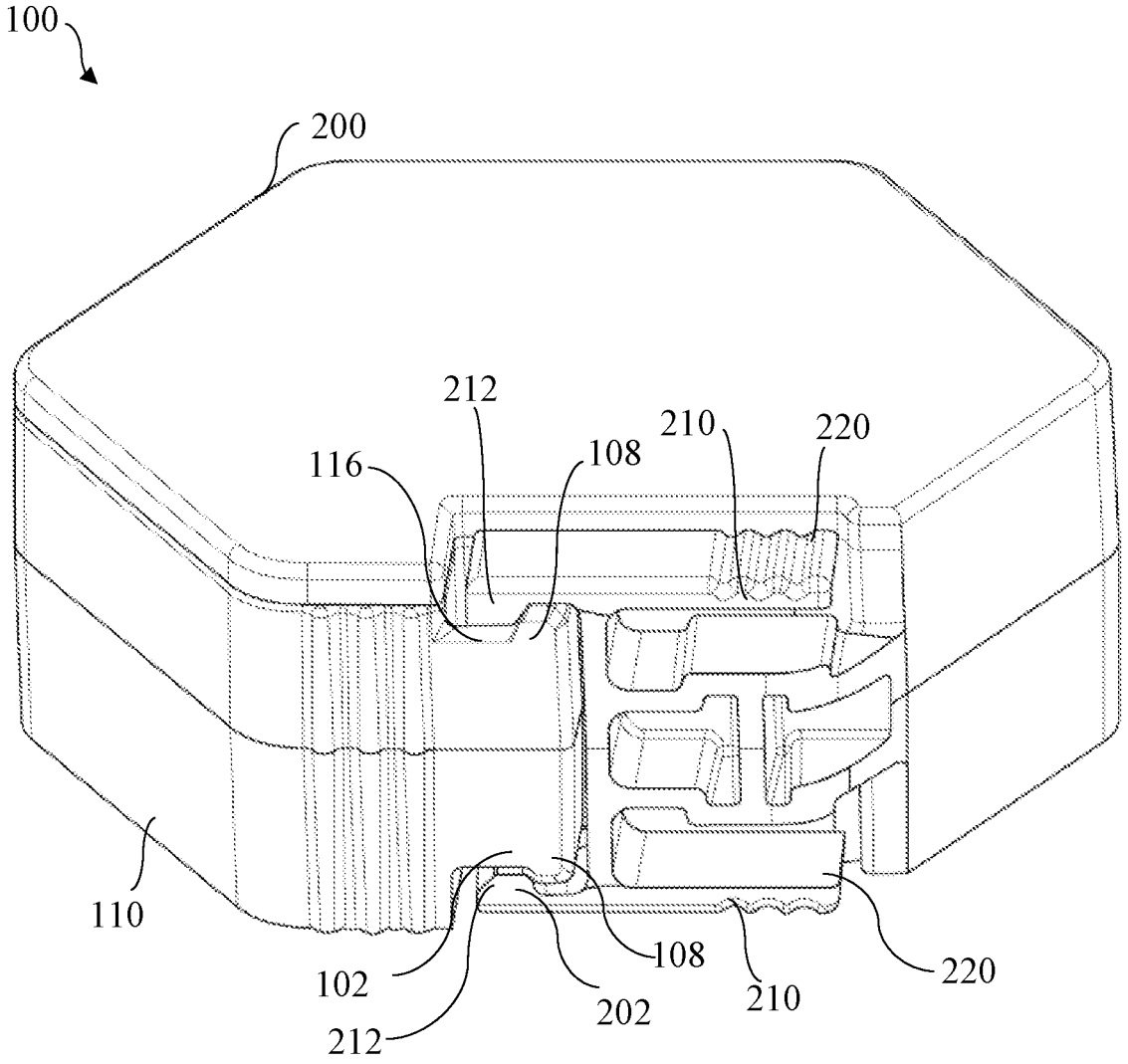
FIG. 2 depicts a top and front perspective view of a hexagonal container, in accordance with an example.
Figure 3:
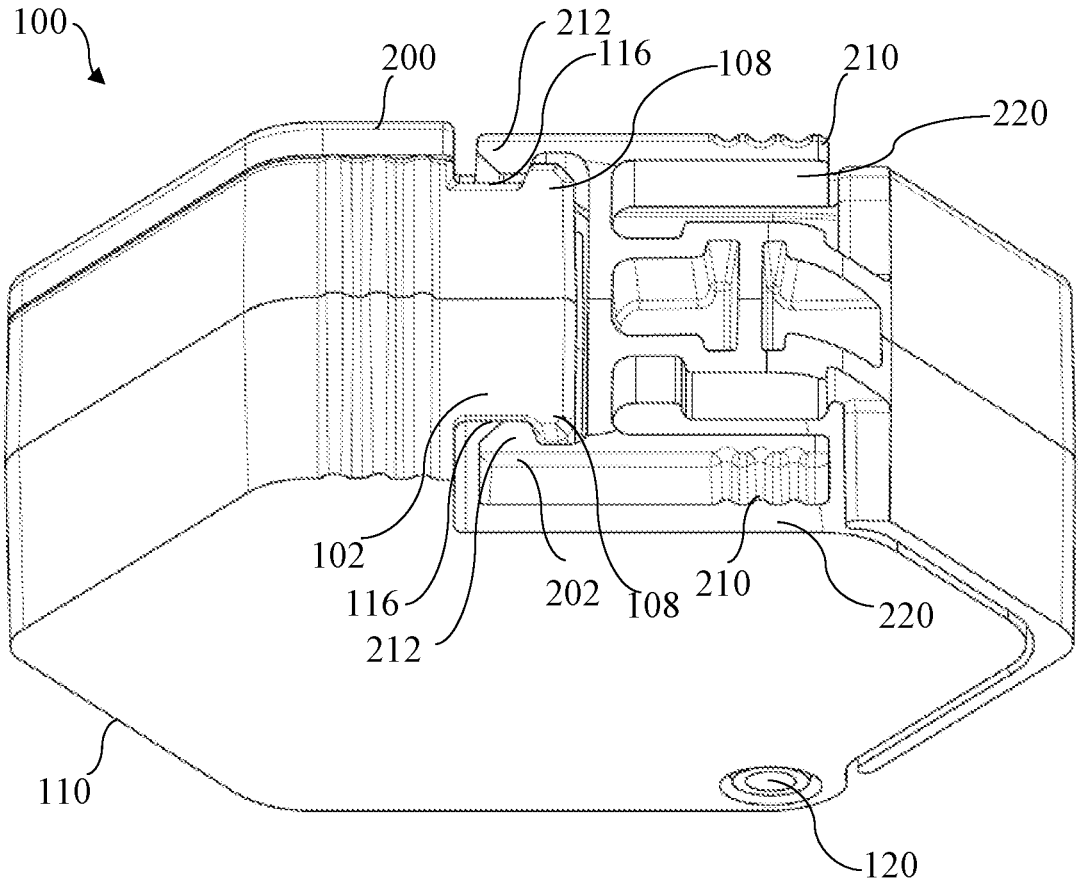
FIG. 3 depicts a bottom and front perspective view of a hexagonal container, in accordance with an example.
Figure 4:
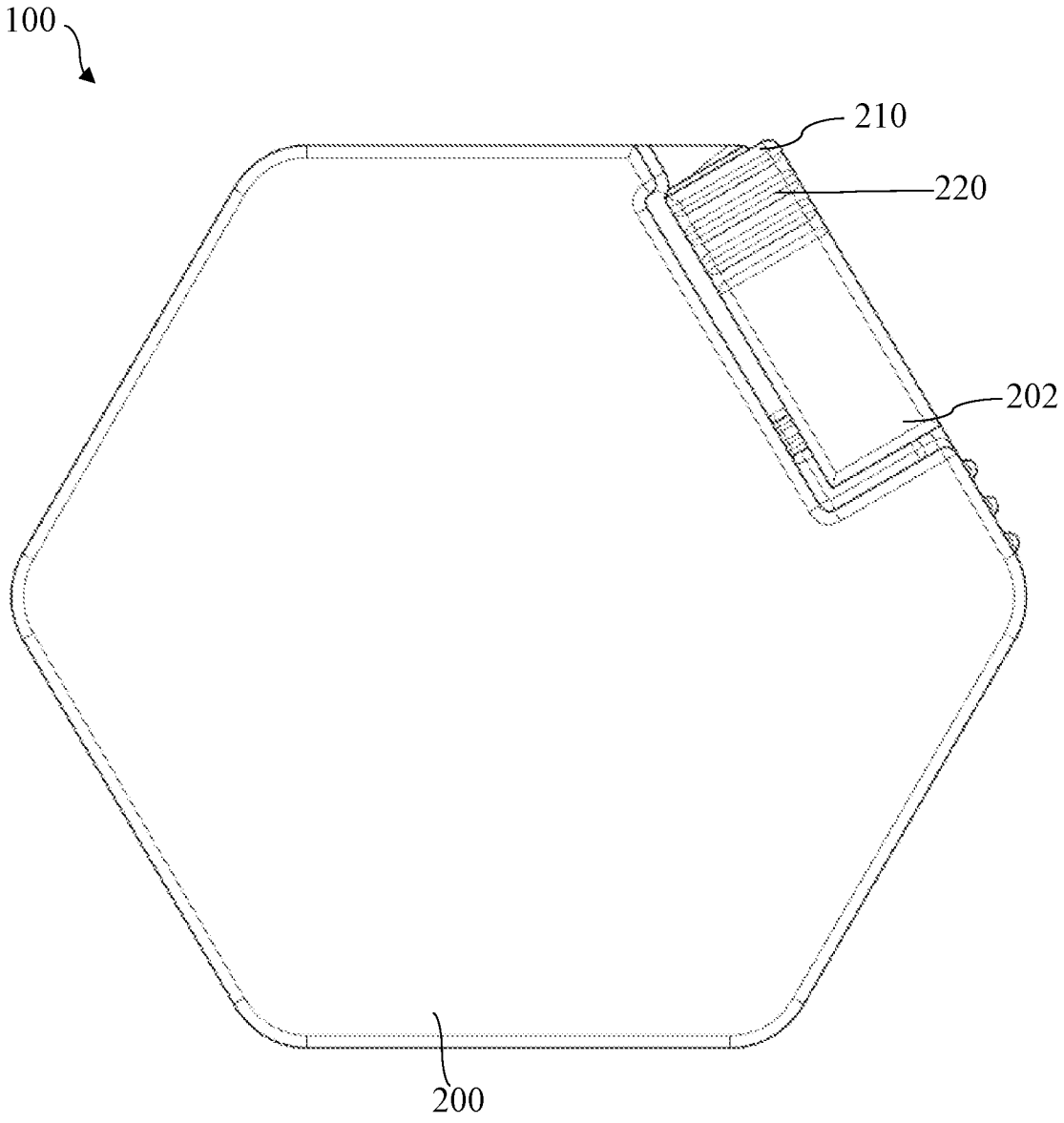
FIG. 4 depicts a top plan view of a hexagonal container, in accordance with an example.
Figure 5:
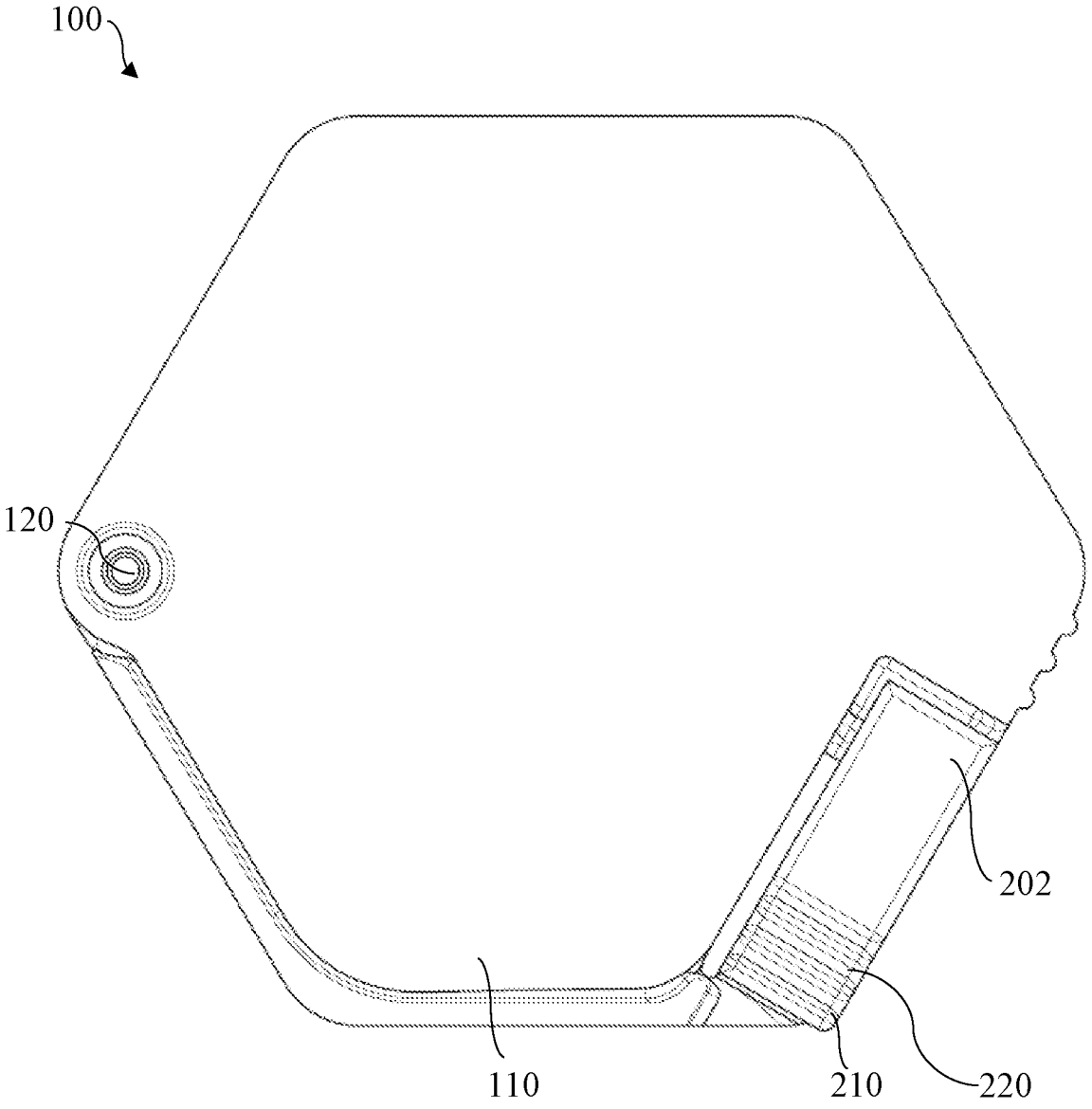
FIG. 5 depicts a bottom plan view of a hexagonal container, in accordance with an example.

Certain terminology is used in the following description for convenience only and is not limiting. The words "right,"

"left," "lower," "upper," "top" and "bottom" designate directions in the drawings to which reference is made. The words "first" and "second" designate an order of operations in the drawings to which reference is made, but do not limit these steps to the exact order described. The words "inwardly" and "outwardly" refer to directions toward and away from, respectively, the geometric center of the container and designated parts thereof Additionally, the terms "a," "an" and "the," as used in the specification, mean "at least one." The terminology includes the words above specifically mentioned, derivatives thereof, and words of similar import.

Referring to the drawings and detail, wherein like numerals indicate like elements throughout, there is shown in FIGS. 1-7 a first preferred embodiment of a child resistant medicate container, generally designated 110 and hereinafter referred to as the "container" 110 in accordance with the present invention. The container 110 is preferably sized and shaped to hold, store, transport and/or dispense medicate or pharmaceutical products, such as pills, tablets, capsules (i.e., oral solids) and/or liquid medicine or the like. Although the container 110 is preferably generally resistant to being opened by a child, as described in detail below, it is understood by those skilled in the art that the container 110 is not so limited, and may simply be a container designed to be openable by a user of any age.

Those of ordinary skill in the art will appreciate from this disclosure that the item(s) and/or contents to be held within the container 110 can be something other than the pills, tablets, capsules and/or liquid discussed above. For example, granular pharmaceuticals, contact lenses suspended in liquid, dental implant components (i.e., screws, inserts, etc.), small hardware and/or electronic parts, cosmetics or similar items potentially hazardous to children or adults can be safely contained in a relatively accessible and convenient manner using the container 110 of the present invention. Likewise, candies, breath mints or any relatively small item generally needing singular dispensing may be stored within the container 110. Thus, the container 110 can be used to contain other contents without departing from the spirit and scope of the present invention.

The container 110 is preferably formed of a high-strength, light-weight material, such as an opaque, translucent, amber or transparent die-formable polymeric material. For example, the container 110 may be formed of polypropylene, polyethylene terephthalate, polycarbonate, acrylic or styrene. However, a wide variety of materials, including but not limited to metals, such as aluminum and stainless steel may be used without departing from the scope and spirit of the invention. To preserve and/or protect the at least one item stored inside the container 110, the material used to form the container 110 is also preferably generally impenetrable and/or resistant to ultraviolet (U.V.) light.

The present invention provides a child resistant box for storage of medicine and similar products or medical devices such as insulin pens, which is readily opened by an adult but is inaccessible to a child.

Referring to FIGS. 1-7, the container 110 preferably includes a generally flat or five-sided shape that at least partially encloses a storage cavity 2000 to hold the pharmaceutical product. Preferably, the pentagon-shaped container 110 has first, second, third, fourth and fifth corners, each of which have a generally arcuate shape and a generally equal radius of curvature. Those of ordinary skill in the art understand that the generally pentagon shape of the container 110 is more efficient for shipping/transporting and automated manufacturing than cylindrical or circular containers.

FIGS. 1-5 show schematically 3-diminisional views of a packaging unit 100 operable for concealing medical device, pharmaceutical devices, herbal supplies, medicinal natural devices, and medication, in its folder or closed state. In its folded or closed state, the packaging unit 100 has two means for opening a lid 200 of the packaging unit 100, located on the top and bottom of the side portion of the lid 200.

The packaging unit 100 has means for opening comprising a first latch portion 202 that includes at least two opening elements 210 as discussed above, on the top and the bottom of the side portion of the lid 200. Each opening elements 210 comprises of one or more release levers 220. When each of the release levers 220 are pressed, by an adult hand squeezing the release levers 220 simultaneously, the first latch portion 202 is released from a second latch portion 102 that is attached or associated with a container 110 portion of the packaging unit 100.

When the packaging unit 100 is in the closed position as indicated in FIG. 1-5, each of the first latch portion 202 and the second latch portion 102 are positionable to be engaged with the other. Further, in the instance where any combination of the release levers 220 are not depressed, the first latch portion 202 and the second latch portion 102 engaged with one another and the lid 200 locks relative to the container 110. That is, the first latch portion 202 and the second latch portion 102 are interconnected with one another, and the lid 200 is securely locked, preventing the lid 200 from disengaging with the container 110 portion.

In some embodiments, a plurality of two or more finger-actuated latches or tool-actuated latches may be released in a certain sequence so as to allow opening of the medical package. In addition, these pluralities of latches can be operable in various combination or simultaneous releases in order to facilitate the opening and closing of the packaging unit 100. In one example, it may be that two or more sets of latches may have to be released in a certain sequence so as to allow opening, thus requiring two adult hands to actuate the two or more set of latches.

In one embodiment, the lid 200 and the container 110 each comprise of a trapezoidal shaped base panel 204, 112 located at the two opposing parallel sides thereof. The container 110 portion further comprises of side walls 114 that extend from the base panel 112 upward, leading to an opening of the container 110, that when packaging unit 100 is closed, creates a fluid connection with the lid 200.

Additionally, upon the closing of the container 110 and the lid 200 portion, and the locking of the lid 200 relative to the container 110, the container 110 and the lid 200 can be child resistant, making the packaging unit 100 resistant to tampering and opening with adult operation.

Figure 6:
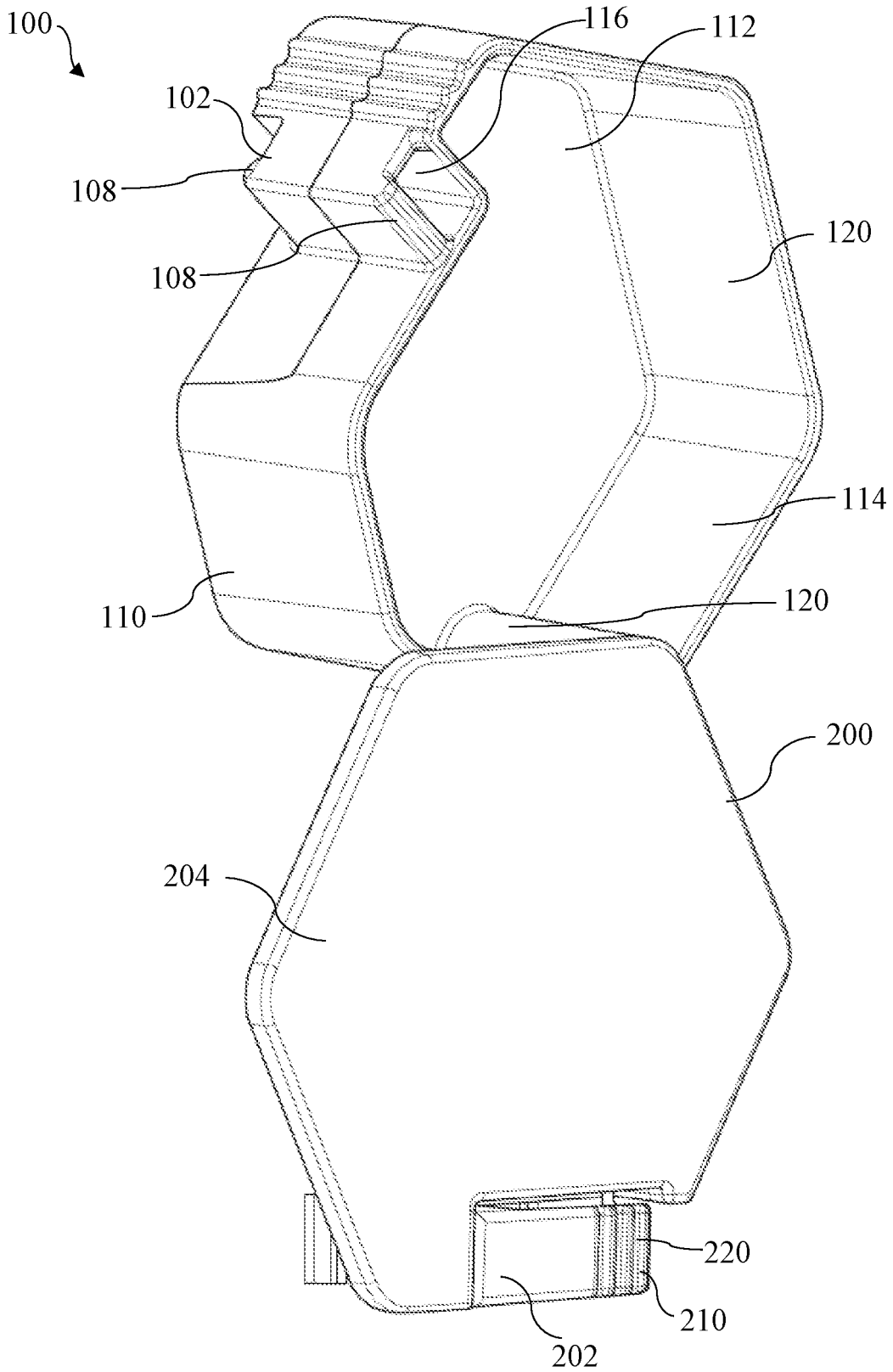
FIG. 6 depicts a top perspective view of a hexagonal container in an open configuration, in accordance with an example.
Figure 7:
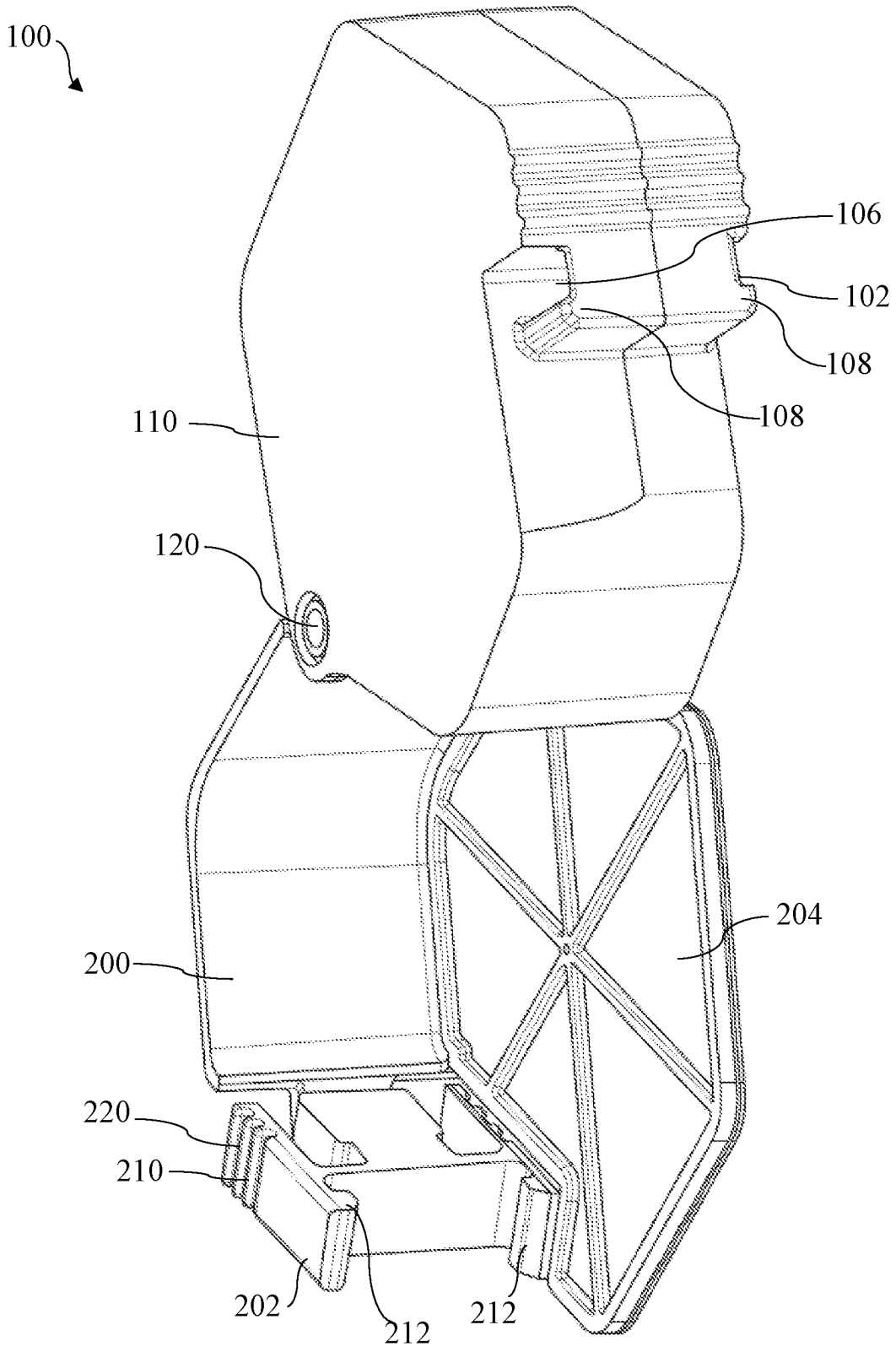
FIG. 7 depicts a bottom perspective view of a hexagonal container in an open configuration, in accordance with an example.

When the packaging unit 100 is in the open position as indicated in FIGS. 6 and 7, the inner portion of the container 110 is exposed, where the one or more medicinal or pharmaceutical devices will be enclosed.

In one embodiment, the lid 200 is pivotally connected and configured to slideably rotate on a pivot 120 and engage the top of the container 110, where the sidewalls 114 end. Additionally, the lid 200 is rotatable in a first direction between a closed position resulting in the lid 200 covering an opening in the container 110, as shown in FIGS. 1-5, and an open position resulting in the opening of the container 110 at least being partially open, as shown in FIGS. 6-7. The lid 200 can be rotated on an axis in a full 180 degree rotation, to fully expose the inside of the container 110, or slightly opened in order to be partially ajar, depending on the user's preference.

According to one aspect of the invention, there is provided a hinge interconnecting the lid and the container. The hinge allows for a user to selectively move the lid between an open, neutral, and closed position. Further, the latching mechanism comprises a selective means and the hinge axis to the deviation are disposed on both sides perpendicular to the box towards the closed position when the lid is in the closed position. Additionally, each latching mechanism can include a latching element also cooperating with an additional latching element coupled on one or more sides of the container, which can be one or more of the other side of the lid, or one of the remaining sides of the container. Accordingly, each latching element is adapted to mutual engagement with one of the cooperative elements to maintain the box in the closed position. Each latching element is adapted to the released position again, only after having the cap rotated toward the neutral position in the closed position releasing the cooperating latching element.

As understood by those of ordinary skilled in the art, the latching mechanism generally locks the cover 200 in the first position (FIGS. 1-5) and provides the child resistant feature of the container 110 such that the user must depress one or both locking mechanisms (depending on the particular embodiment), generally with a thumb and index finger, and then slide the cover toward the second position (FIGS. 6-7) to dispense the contents from within the container 110.

In one embodiment, as a result of a first release lever 220 and a second release 220 lever being simultaneously pressed, the lid 200 can unlock, resulting in the first latch portion 202 disengaging from the second latch portion 102.

In one embodiment, the second latch portion 102 that is associated with the container 110 can be configured to be positioned within an indention 116 in one of the sides of the container 110. This indention can house the second latch portion 102, and be configured to receive the first latch portion 202 associated with the lid 200. Additionally, the second latch portion 102 can comprise of a first shoulder 108 located at the top of the second latch portion 102, and a second shoulder 108 located at the bottom of the second latch portion 102.

In addition, the first latch portion 202 that is associated with the lid 200, can be configured to be positioned relative to the first latch portion 202 associated with the container 110. The second latch portion 102 is configured to be the width of the lid 200 and the container 110 if in the closed position. Additionally, the first latch portion 202 comprises a first opening elements 210 and a second opening elements 210 located at the top and bottom of the first latch portion 202 respectively. Each of the first and second opening elements 210 comprise of a first and second lip 212, respectively, on one end, and a first and second release lever 220, respectively, on the opposite end.

In the instance where the packaging unit 100 is in the closed position, the first and the second lip 212 of the first latch portion 202 of the lid 200, are configured to securely enclose around the first and second shoulders 108 of the container 110. In essence, the lid 200 and the container 110 are retained in place, and locked from being opened when each of the first and second lip 212, and the first and second shoulders 108 are in securable connection with each other. In order to transition the packaging unit 100 to the open position, the first and the second release lever 200 of the lid 200, are pressed simultaneously, in order to release the first and second lips 212 of the lid 200, from the first and second shoulders 108 of the container 110. Accordingly, the lid 200 is able to be rotated along the axis in order to expose the contents within the container 110.

Although the present invention has been described in connection with the specified embodiments, it should not be construed as being in any way limited to the presented examples. The scope of the present invention is set out by the accompanying claim set. In the context of the claims, the terms "comprising" or "comprises" do not exclude other possible elements or steps. Also, the mentioning of references such as "a" or "an" etc. should not be construed as excluding a plurality. The use of reference signs in the claims with respect to elements indicated in the figures shall also not be construed as limiting the scope of the invention. Furthermore, individual features mentioned in different claims, may possibly be advantageously combined, and the mentioning of these features in different claims does not exclude that a combination of features is not possible and advantageous.

It is envisioned that other styles and configurations can be easily incorporated into the teachings of the present disclosure and only one particular configuration has been shown and described for purposes of clarity and disclosure and not by way of limitation of scope.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

It is to be understood that the present invention is not limited to the embodiments described above, but encompasses any and all embodiments within the scope of the following claims.

What is claimed is:

1. A hexagonal packaging unit, comprising:

a container adapted to hold contents, wherein the contents are one or more of a pharmaceutical composition or medical devices;

a lid pivotally connected and configured to slidably rotate on a pivot and engage a top of the container, wherein the lid is rotatable in a first direction between a closed position resulting in the lid covering an opening in the container, and an open position resulting in the opening of the container at least being partially open;

a first latch portion associated with the lid comprising a first lip and a first release lever located at a first side of the first latch portion and a second lip and a second release lever located at a second side of the first latch portion opposite from the first side; and a second latch portion associated with the container positionable to engage the first latch portion when the lid is in the closed position, and disengage when the lid is in the open position, wherein the second latch portion associated with the container further comprises a first shoulder located at a first side of the second latch portion, and a second shoulder located at a second side of the second latch portion opposite from the first side, wherein, when the first latch portion engages the second latch portion, the first lip of the first latch portion abuts the first shoulder of the second latch portion and the second lip of the first latch portion abuts the second shoulder of the second latch portion, and wherein as a result of the first release lever being pressed towards the second release lever and the second release lever being pressed towards the first release lever, the lid unlocks, resulting in the first latch portion disengaging from the second latch portion.

2. The hexagonal packaging unit of claim 1, wherein as a result of the first release lever and the second release lever not being depressed, the first latch portion engages the second latch portion and the lid locks relative to the container, latching the first latch portion with the second latch portion.

3. The hexagonal packaging unit of claim 1, wherein the lid and container each comprise of base panels located at two opposing parallel sides thereof.

4. The hexagonal packaging unit of claim 1, wherein the container and the lid are child resistant.

5. The hexagonal packaging unit of claim 1, wherein the container comprises side walls extended from a base panel to the opening of the container.

6. The hexagonal packaging unit of claim 1, wherein the second latch portion that is associated with the container is configured to be positioned within an indention in the container.

7. The hexagonal packaging unit of claim 6, wherein the indention is configured to receive the first latch portion associated with the lid.

8. The hexagonal packaging unit of claim 2, wherein the first latch portion comprises a first opening element and a second opening element located at the top and bottom of the first latch portion.

9. The hexagonal packaging unit of claim 8, wherein the first and second opening elements respectively comprise the first lip and the second lip on one end, and the first and second release lever, on an opposite end.

10. The hexagonal packaging unit of claim 1, wherein the lid is configured to be rotated along an axis resulting in at least a partial exposure of contents within the container.

* * * * *